US006491538B2

(12) United States Patent
Fenger

(10) Patent No.: US 6,491,538 B2
(45) Date of Patent: Dec. 10, 2002

(54) CABLE-HARNESS PLUG HAVING A LOCKING ARM

(75) Inventor: Stefan Fenger, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/732,829

(22) Filed: Dec. 8, 2000

(65) Prior Publication Data

US 2001/0016444 A1 Aug. 23, 2001

(30) Foreign Application Priority Data

Dec. 8, 1999 (DE) ..... 199 59 024

(51) Int. Cl.[7] ..... H01R 13/627
(52) U.S. Cl. ..... 439/358; 439/587
(58) Field of Search ..... 439/350, 352, 439/357, 358, 587

(56) References Cited

U.S. PATENT DOCUMENTS 3,933,406 A * 1/1976 Cameron et al. ..... 439/358
5,830,002 A * 11/1998 Ito et al. ..... 439/358

FOREIGN PATENT DOCUMENTS

JP 02040875 A * 2/1990 ..... H01R/13/639

* cited by examiner

*Primary Examiner*—Gary H. Paumen
*Assistant Examiner*—James R. Harvey
(74) *Attorney, Agent, or Firm*—Kenyon & Kenyon

(57) ABSTRACT

An interlocking mechanism designed to have an increased locking force, which can simultaneously be actuated by a small force. To this end, an electric connector, which includes a coupling part and a plug part, has a locking element that has a bending arm pointing away from the plug part, and a lever arm running transversely to the bending arm. A stop element is positioned on the side of the bending arm that faces the coupling part in the plugged-in state, the stop element being designed in such a manner that the movement of the bending arm is restricted in the direction of stop element, and that the bending arm can swing horizontally away from the stop element.

4 Claims, 3 Drawing Sheets

CABLE-HARNESS PLUG HAVING A LOCKING ARM

FIELD OF THE INVENTION

The present invention starts out from an electric connector having a coupling part and a plug part, which can be inserted in an opening of the coupling part; the outer side of the coupling part having at least one locking surface on it, with which a locking element mounted on the plug part engages, in the plugged-in state; and the locking element including a bending arm pointing away from the plug part, and a lever running transversely to the bending arm, so that the lever can be guided around the bending arm in a springlike manner, from a normal position into a release position, and then back into the normal position.

BACKGROUND INFORMATION

In the case of electric connectors, which include a plug part and a coupling part adapted to this plug part, it is known to provide appropriate interlocking devices that prevent the connector from being released unintentionally. These interlocking devices are usually designed as elastic elements, such as springs, hooks, and the like, which engage with the locking element in response to closing the plug connection.

When these connectors are subjected to high mechanical stresses, e.g. in the case of connectors on board a motor vehicle, it is necessary to reinforce the elements required for locking, so that the considerable mechanical stresses on the plug connection do not detach the connector during the operation of the motor vehicle.

In the connector design described here, the related art especially provides for reinforcing the bending arm, e.g. by increasing the cross-section or selecting a different plastic. However, this results in the disadvantage of the connector only being guidable with increased expenditure of force, since the connection between the lever arm and the bending arm is very stiff, and therefore, the lever arm can only be moved from a normal position into a release position, and back again, by applying this greater force. On the other hand, connectors are proposed in which the bending arm is designed to be "soft". This means that the bending arm may have a small cross-section, or that a very flexible plastic is used to form the bending arm. This design of a bending arm has the disadvantage of the locking connection being automatically released, particularly in response to a temperature change or vibrational forces, so that the plug part and coupling part detach from one another.

SUMMARY OF THE INVENTION

Therefore, an object of the present invention consists in providing an electric connector, in which the locking connection has an increased locking force, while the force required to release the locking connection is smaller.

The achievement principal of the object consists in further developing a locking connection known per se for electric connectors, in such a manner, that the locking connection is especially not released in response to tensile loads on the plug part. This is accomplished by using a stop element to limit the movement of the locking element.

In order to achieve the object, it is proposed that a stop element be arranged on the side of the bending arm that faces the coupling part of the electric connector, in the plugged-in state; the stop element being designed in such a manner, that the movement of the bending arm is restricted in the direction of the stop, and the horizontal sweep of the bending arm away from the stop element is not hindered.

One fundamental advantage of the present invention is that the interaction of the "soft" bending-arm design with the stop element of the present invention prevents stresses occurring on the locking connection, and the deformation resulting therefrom, from releasing the lever arm from the locking element. Another fundamental advantage of the design according to the present invention is that the horizontal sweeping motion of the bending arm to release the locking connection can be brought about without hindrance, and the "soft" design of the bending arm also allows this motion to be effected without increased expenditure of force.

The stop element is advantageously positioned in direct proximity to the bending arm, and is preferably formed as one piece with the plug part.

DETAILED DESCRIPTION

Figure 1:
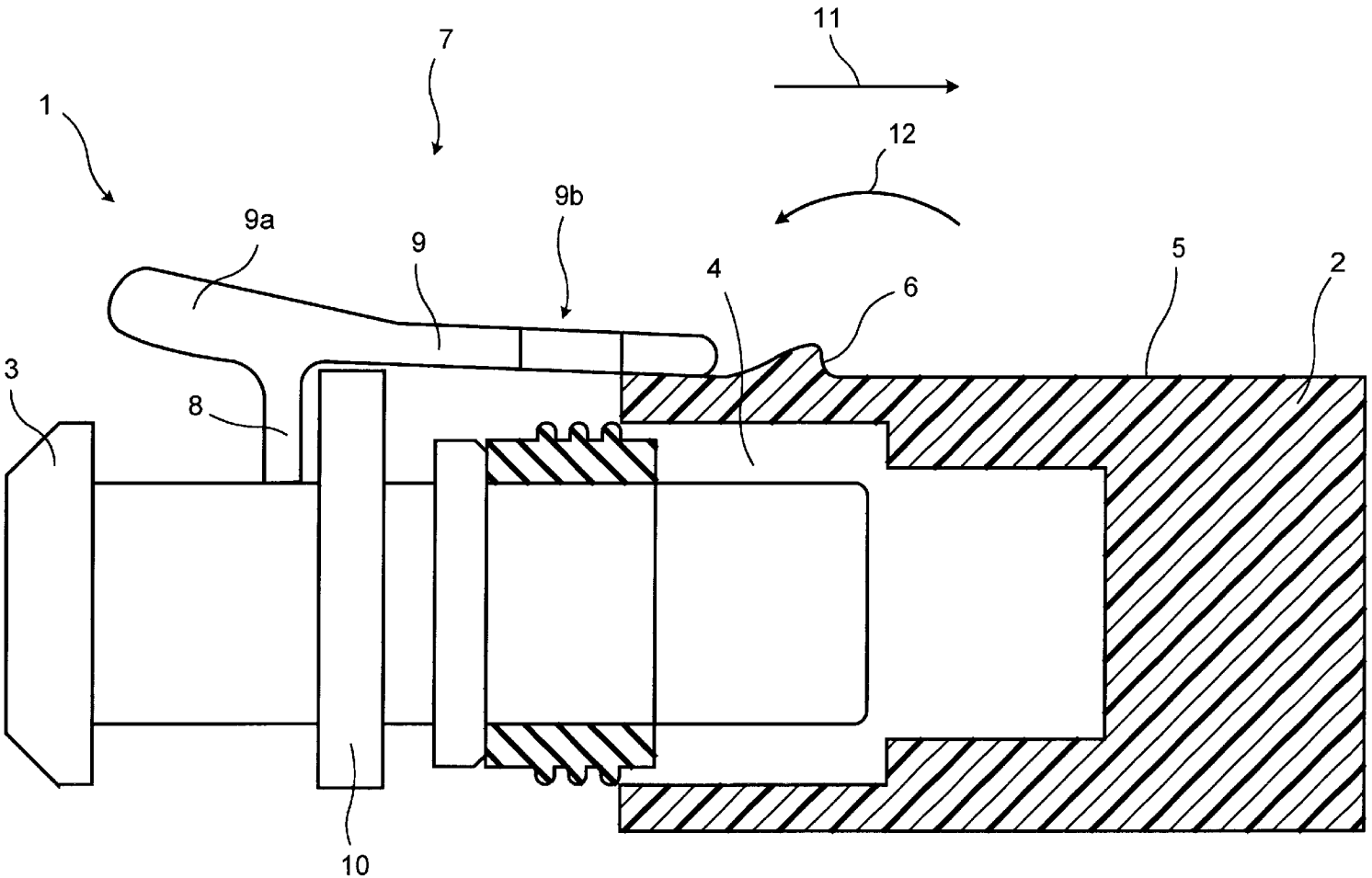
FIG. 1 shows an exemplary embodiment of the electric connector according to the present invention, the plug part and the coupling part being separated from each other.

Electric connector 1 represented in FIG. 1 includes a coupling part 2 and a plug part 3, coupling part 2 having an opening 4 in which plug part 3 can be inserted.

Outer side 5 of coupling part 2 has a locking surface 6 on it, which is formed as a locking lip in the exemplary embodiment represented in FIG. 1. This locking surface 6 is formed in such a manner that a locking element 7, which is connected to plug part 3, and includes a bending arm 8 and a lever arm 9, engages with locking surface 6.

Locking element 7 of plug part 3 is formed in such a manner, that bending arm 8 extends almost perpendicularly away from the outer surface of plug part 3, lever arm 9 being mounted transversely, and preferably perpendicularly, on the free end of bending arm 8. Lever arm 9 is formed in such a manner, that it is divided up into two regions 9*a* and 9*b*, region 9*a* of lever arm 9 being intended for operating a locking element 7, and region 9*b* being provided for establishing a locking connection with locking surface 6. Bending arm 8 is directly pivoted on the lower side, i.e. on the side facing plug part 3, and divides both regions 9*a* and 9*b*.

A stop element 10 is positioned on the side of bending arm 8 that faces coupling part 2 in the plugged-in state. This stopping element 10 is formed in such a manner, that the axial bending of locking element 7 is restricted in arrow direction 1 1, whereas the unhindered horizontal sweeping motion of bending arm 8 and locking element 7 is possible in the reverse direction (in arrow direction 12).

Figure 2:
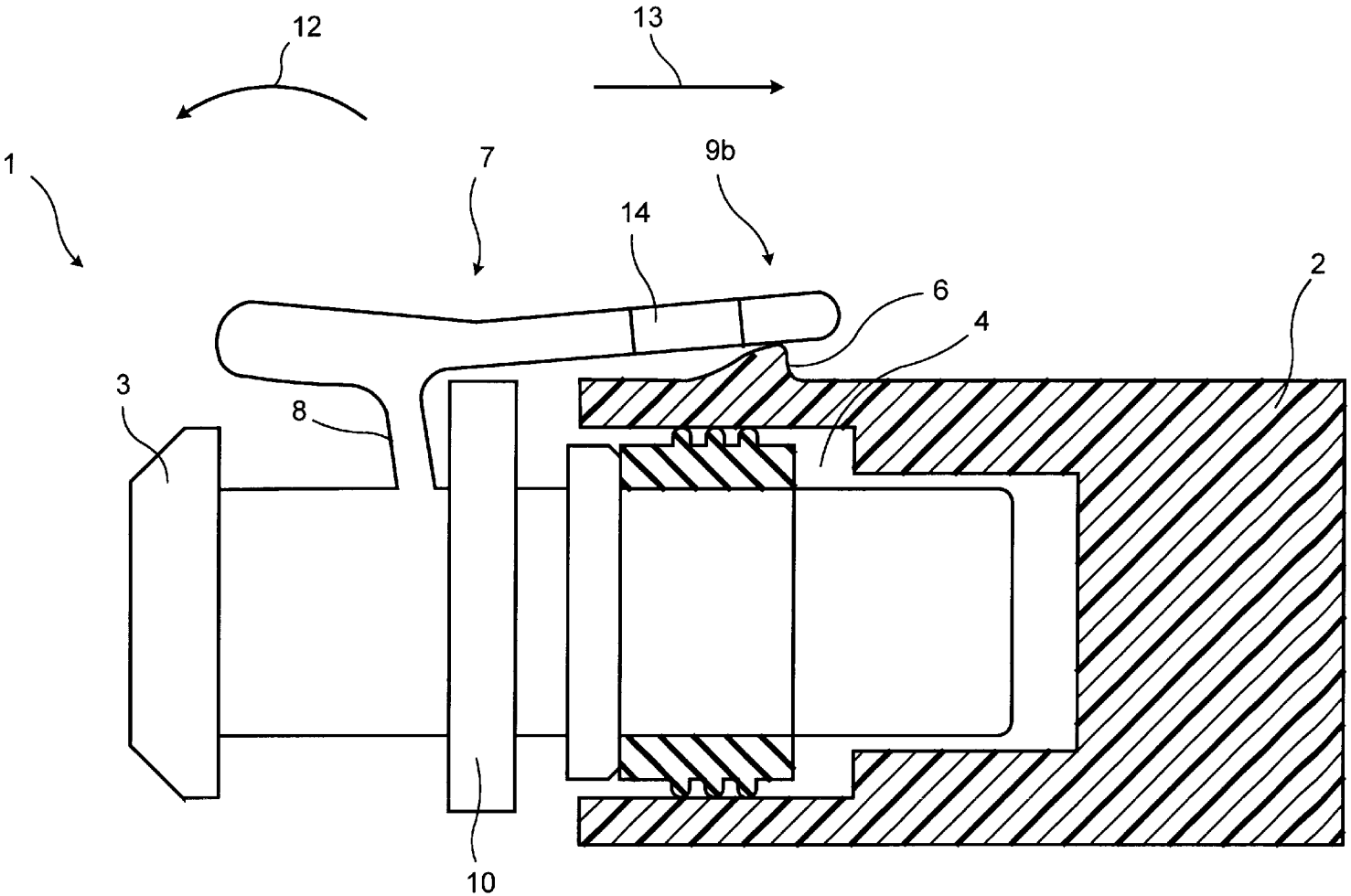
FIG. 2 shows the electrical connector as shown in FIG. 1, but in the state of creating a plug connection.
Figure 3:
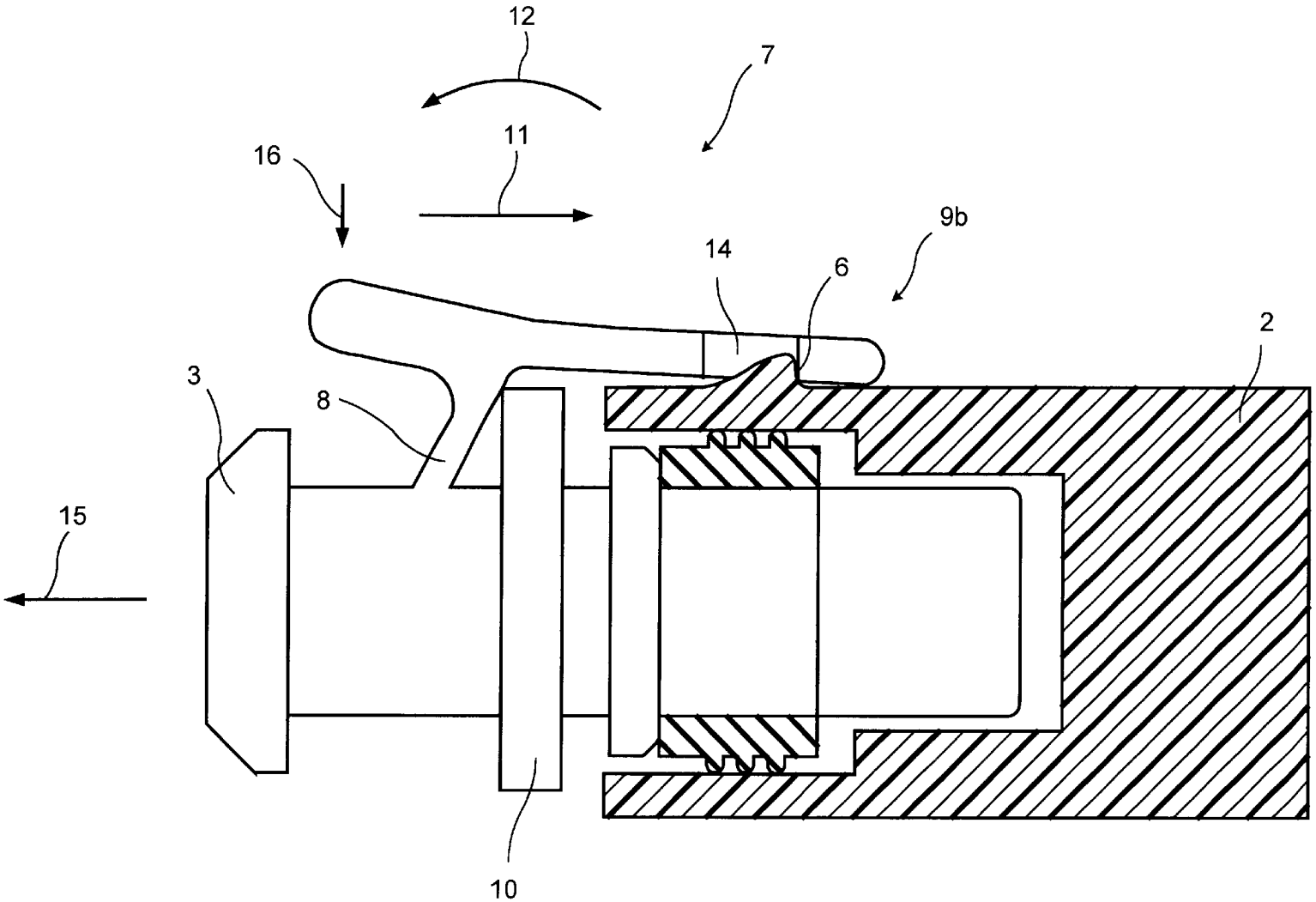
FIG. 3 shows the electric connector of FIG. 1, in the plugged-in state.

In electric connector 1 represented in FIG. 2, plug part 3 is already being plugged into coupling part 2. Plug part 3 is inserted into opening 4 of coupling part 2, in arrow direction 13 represented in FIG. 2; during the insertion, locking element 7 and bending arm 8 swinging in arrow direction 12, until notch 14 provided in region 9*b* in locking element 7 covers locking surface 6, as is represented in FIG. 3. If locking element 7 covers locking surface 6, then locking element 7 assumes the normal position again, as was already shown in FIG. 1.

If, e.g. a tensile force now acts on plug part 3 in the direction of arrow 15, as is represented in FIG. 3, then stop element 10 prevents a movement in the direction of arrow 1 1, and therefore prevents the locking connection from being released, in spite of the "soft" design of bending arm 8.

However, the "soft" design of bending arm 8 allows it to be actuated easily, and with a small force, in the direction of arrow 16, which causes locking element 7, and in particular, bending arm 8 to swing in the direction of arrow 12, so that the locking connection between locking element 7 and locking surface 6 is released, and therefore, the connection between coupling part 2 and plug part 3 is released.

The special positioning of the stop element in the described connector allows the manufacture of a highly user-friendly connector, which has a high stiffness in the plugging direction. Therefore, a reliable plug connection is even possible under extreme conditions such as temperature change and vibrational stress, and at the same time, the very "soft" connection of the locking element allows the connector to be easily operated and released.

LIST OF REFERENCE NUMERALS

1) electric connector
2) coupling part
3) plug part
4) opening
5) outer side
6) locking surface
7) locking element
8) bending arm
9) lever arm
9*a*) region of lever
9*b*) region of lever
10) stop element
11) arrow
12) arrow
13) arrow
14) notch
15) arrow
16) arrow

What is claimed is:

1. An electric connector, comprising:

a coupling part including an outer side on which at least one locking surface is arranged;

a plug part capable of being inserted into an opening of the coupling part;

a locking element positioned on the plug part and for engaging in a plugged-in state with the at least one locking surface, wherein the locking element includes:

a bending arm pointing away from the plug part, and a lever arm running transversely to the bending arm so that the lever arm is capable of being guided around the bending arm in a springlike manner from a normal position into a release position, and back into the normal position; and a stop element positioned on a side of the bending arm facing towards the coupling part in the plugged-in state, wherein:

the stop element is designed such that a movement of the bending arm is limited by direct engagement of the bending arm and the stop element, and the bending arm is capable of swinging horizontally away from the stop element without hindrance.

2. The connector according to claim 1, wherein:

the stop element is positioned on the plug part.

3. The connector according to claim 1, wherein:

the stop element is positioned on the coupling part.

4. The connector according to claim 1, wherein:

the at least one locking surface is formed in a shape of a locking lip that engages with a notch in the lever arm of the locking element in order to lock the connector.

* * * * *